United States Patent [19]

Thomsen

[11] Patent Number: 4,891,954

[45] Date of Patent: Jan. 9, 1990

[54] REFRIGERATED CONTAINER

[75] Inventor: Van E. Thomsen, Enumclaw, Wash.

[73] Assignee: Sheffield Shipping & Management Ltd., Barbados

[21] Appl. No.: 300,444

[22] Filed: Jan. 19, 1989

[51] Int. Cl.[4] ..... B60H 3/04

[52] U.S. Cl. ..... 62/239; 62/388

[58] Field of Search ..... 62/384, 388, 239

[56] References Cited

U.S. PATENT DOCUMENTS

| | | | |
|---|---|---|---|
| 3,561,226 | 2/1971 | Rubin | 62/388 |
| 4,498,306 | 2/1985 | Tyree, Jr. | 62/384 |
| 4,502,293 | 3/1985 | Franklin, Jr. | 62/388 |
| 4,593,536 | 6/1986 | Fink et al. | 62/239 |
| 4,704,876 | 11/1987 | Hill | 62/388 |
| 4,761,969 | 8/1988 | Moe | 62/388 |
| 4,825,666 | 1/1989 | Saia, III | 62/384 |

OTHER PUBLICATIONS

American Frozen Food Institute Study titled, Executive Summary Report, dated Mar. 1985, "Cryogenic Rail Car Project".

*Primary Examiner*—Ronald C. Capossela

*Attorney, Agent, or Firm*—Christensen, O'Connor, Johnson & Kindness

[57] ABSTRACT

A refrigeration system (10) consisting of an insulated railcar (12) that utilizes sublimated carbon dioxide to maintain the integrity of stored products. The insulated railcar (12) includes a divider (22) that partitions the insulated railcar (12) into a lower storage area (26) and an upper bunker (24). The bunker (24) contains a distribution manifold (28) for forming carbon dioxide snow and distributing the formed snow throughout the bunker (24). Sublimation ports (30) along each sidewall (18) and end wall (20) allow the sublimated carbon dioxide to pass to the lower storage area (26) to refrigerate the stored products during transit. A plenum (42) and emission vent (44) is provided at each end of the insulated railcar (12) to vent sublimated carbon dioxide to the exterior atmosphere. The insulated railcar (12) also includes pressure relief ports (32) located substantially below the distribution manifold (28) to vent flash gas generated during the snow forming process.

9 Claims, 3 Drawing Sheets

REFRIGERATED CONTAINER

TECHNICAL AREA

This invention relates to refrigeration systems for vehicles, and more particularly, to fully-integrated or stand-alone containers utilizing carbon dioxide as a refrigerant in the transportation of products by vehicles such as railcars, ships, trucks, trailers and the like.

BACKGROUND OF THE INVENTION

The prior art is replete with refrigeration systems that utilize carbon dioxide as the refrigerant material. Carbon dioxide is ideal for such purposes because its liquid form may be easily flashed to create a refrigerating solid form, commonly known as snow.

The American Frozen Food Institute conducted a feasibility study as to the prospects of developing a cryogenic system suitable for shipping frozen foods and the like in railcars. This feasibility study culminated in an Executive Summary Report, dated March 1985, that described a prototype railcar wherein liquid carbon dioxide was stored in a series of tanks spaced beneath the floor of the railcar. Refrigeration was accomplished by venting the liquid carbon dioxide onto the top of the load stored in the railcar. This venting process formed a blanket of carbon dioxide snow over the load, which was repeated as required during shipment. A drawback of this prototype railcar was that because of the direct contact of the snow with the load, certain products were reduced to extremely low temperatures, thereby becoming very brittle and breaking.

This drawback was circumvented by the design disclosed in Fink et al., U.S. Pat. No. 4,593,536. Fink et al. included a divider that created a bunker along the upper regions of the railcar where carbon dioxide snow was deposited. This bunker system also had the advantage of allowing each railcar to be charged with a load of snow that would last many days, thus alleviating the problem of having to carry a source of liquid carbon dioxide onboard. Vents were provided in the divider along one sidwall that allowed the escape of sublimated carbon dioxide into the storage compartment below to provide the necessary refrigeration. It was theorized that the cold carbon dioxide gas would flow downwardly along the one sidewall, through passageways beneath the floor, and then upwardly along the opposite sidewall and back across the load. In reality, the carbon dioxide gas did not effectively flow upwardly along the opposite sidewall or across the load, thus leaving areas improperly refrigerated during transit.

This drawback was improved upon in the design disclosed in Hill, U.S. Pat. No. 4,704,876. Hill utilized the bunker concept, but provided openings in the divider along both sidewalls, as well as both end walls. Flow of the sublimated carbon dioxide occurred down all four walls until reaching a system of channels located along the floor of the storage compartment. The channels were created by a series of T-beams running substantially the length of the railcar. These channels collected the carbon dioxide gas and routed the gas first to a collection manifold located at one end of the railcar and then to the atmosphere exterior to the railcar through a discharge duct connected to the collection manifold.

An alteration to the basic design of Hill was suggested in Moe, U.S. Pat. No. 4,761,969. It is well known that certain perishable products cannot be allowed to be contacted by carbon dioxide vapors. This is because products such as lettuce, cabbage,asparagus, etc. will turn black or otherwise discolor upon exposure to carbon dioxide vapors, rendering the products aesthetically unappealing to the consumer. In an effort to overcome this problem, Moe disclosed a design that theoretically would allow the refrigerated container to operate in a second mode whereby carbon dioxide snow was created and stored in a flexible bladder located in the bunker. The gases produced upon sublimation of the snow passed to the exterior of the container through a bladder vent, thus keeping the carbon dioxide vapors isolated from the stored product at all times. Under this design, the bladder acted as a cold convection plate to chill the product stored within the lower compartment. To date, this bladder concept has never been commercially employed. Further, it is doubtful that any material could provide the elastic properties required of such a bladder at the tremendously low temperatures associated with using carbon dioxide as a refrigerant.

While both the Hill design and the Moe design provided more uniform refrigeration, the divider between the bunker and the storage area below would often be blown out while the railcar was being charged with liquid carbon dioxide to create the required blanket of snow in the bunker. This problem was due to a number of misconceptions on the part of prior designers. First, it was believed that the blanket of snow would build from the inside out, i.e., from the central region of the bunker beneath the centrally located discharge manifold outwardly to each of the sidewalls. Consequently, the prior designers were not concerned about he vents along the sidewall becoming plugged with carbon dioxide snow. In actuality, just the opposite effect was true. Due to the tremendous pressure at which the liquid carbon dioxide was extruded through the distribution manifold, the blanket of snow would actually build from the outside in, i.e., from the sidewalls inwardly toward the center of the bunker. Thus, plugging the vents was a critical concern. Second, prior designers had not recognized nor accounted for the huge amount of pressure that would build up in the bunker if a proper ventilation area was not provided. This tremendous pressure build up occurred because during the process of converting liquid carbon dioxide into solid snow, only approximately 45% of the liquid carbon dioxide becomes snow. The balance becomes flash gas which must immediately be removed to prevent rupture of the divider.

Thus, the need for a refrigeration system for railcars that allows proper ventilation during the process of creating the blanket of snow in the bunker, and that provides uniform refrigeration during tránsit, is significant. This invention is directed to satisfying this need.

SUMMARY OF THE INVENTION

In accordance with this invention, a refrigeration system that utilizes a cryogenic refrigerant material to maintain the integrity of stored products is disclosed. The refrigeration system includes an insulated container having a floor, a ceiling, sidewalls, and end walls, wherein the sidewalls define the length and the end walls define the width of the insulated container; dividing means for partitioning the insulated container into an upper bunker and a lower storage area, wherein the dividing means is capable of supporting a supply of snow formed of a cryogenic material; manifold means located in the upper regions of the bunker substantially along the longitudinal centerline of the bunker for forming cryogenic snow and distributing the formed cryogenic snow throughout the bunker; a plurality of apertures extending through the dividing means adjacent the sidewalls and end walls for permitting the flow of sublimated cryogenic gas from the bunker to the storage area, each aperture having a first peripheral housing extending substantially above the dividing means into the bunker; at least one vent extending through the dividing means that is located substantially along the longitudinal centerline of the dividing means, each at least one vent having a second peripheral housing extending substantially above the dividing means into the bunker; a plurality of channels extending substantially the entire length of the insulated container along the floor for collecting sublimated cryogenic gas; and, emission means communicating between the channels and the exterior of the insulated container for discharging the collected sublimated cryogenic gas to the atmomsphere exterior to the insulated container.

In an alternative form of the invention, the manifold means runs substantially the length of the bunker, but is located away from the longitudinal centerline of the bunker. Under this arrangement, the at least one vent is located substantially below the manifold means.

In a preferred embodiment of the invention, the insulated container of the refrigeration system is an insulated rail car, and the cryogenic material is carbon dioxide. Further, the refrigeration system includes a plurality of vents extending through the dividing means that are located in a spaced relationship substantially along the longitudinal centerline of the dividing means. If the above mentioned alternative form of the invention is employed, this plurality of vents would correspondingly be located substantially below the manifold means, and not along the longitudinal centerline of the dividing means. Further, the preferred embodiment of the refrigeration system includes means for placing adjacent channels in fluid communication to allow the flow of sublimated carbon dioxide in the widthwise direction.

BRIEF DESCRIPTION OF THE DRAWINGS

The foregoing and other features and advantages of the present invention will become more readily appreciated as the same becomes better understood by reference to the following description of a preferred embodiment of the invention and the accompanying drawings wherein.

DESCRIPTION OF THE PREFERRED EMBODIMENT

Figure 1:
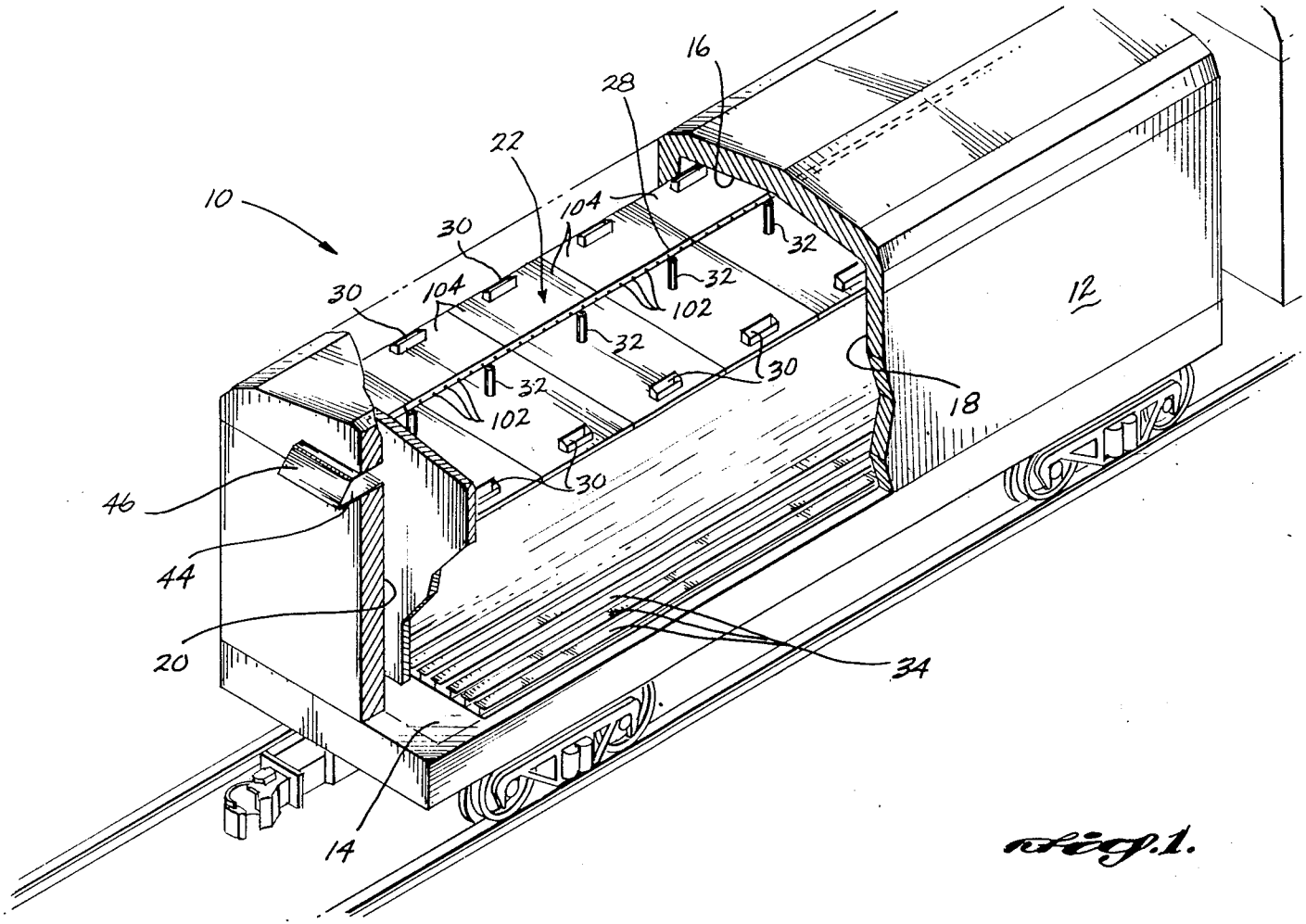
FIG. 1 is a partially cut-away isometric view showing the refrigeration system formed in accordance with the invention as applied to an insulated railcar.

FIG. 1 illustrates the refrigeration system 10 formed in accordance with this invention applied to an insulated railcar 12. The interior region of the insulated railcar 12 is defined by a floor 14, a ceiling 16, sidewalls 18, and end walls 20. A divider 22 partitions the interior of the insulated railcar 12 into an upper bunker 24 containing a blanket of carbon dioxide snow 106 and a lower storage area 26.

Figure 2:
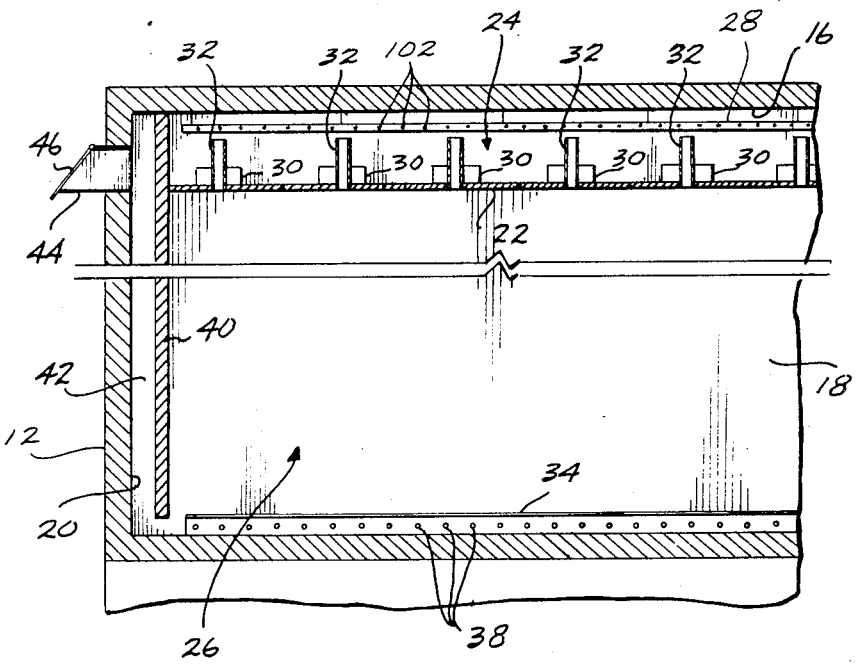
FIG. 2 is a side view in section of one end of the insulated railcar illustrated in FIG. 1.
Figure 3:
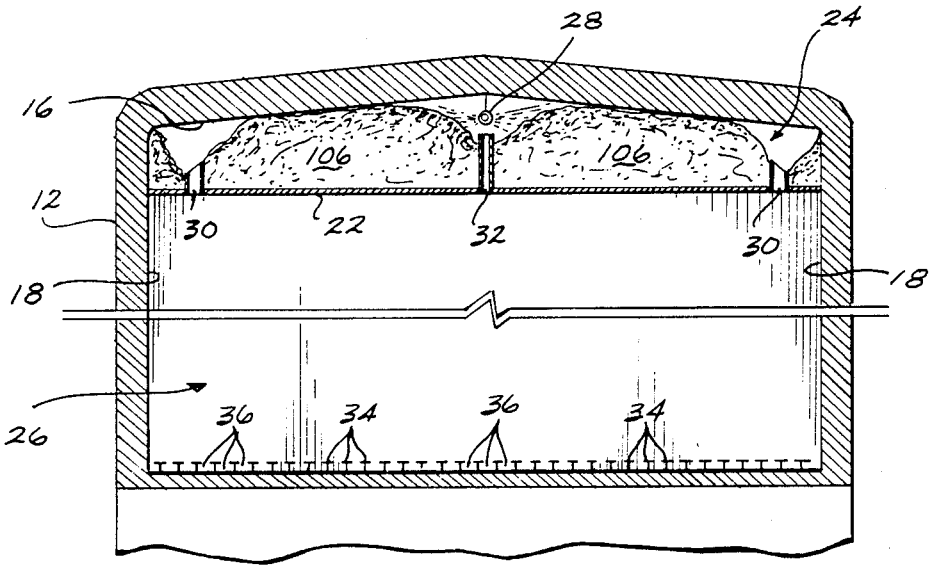
FIG. 3 is an end view in section of the insulated railcar illustrated in FIG. 1 showing a centerline-based distribution manifold and pressure relief port arrangement.
Figure 4:
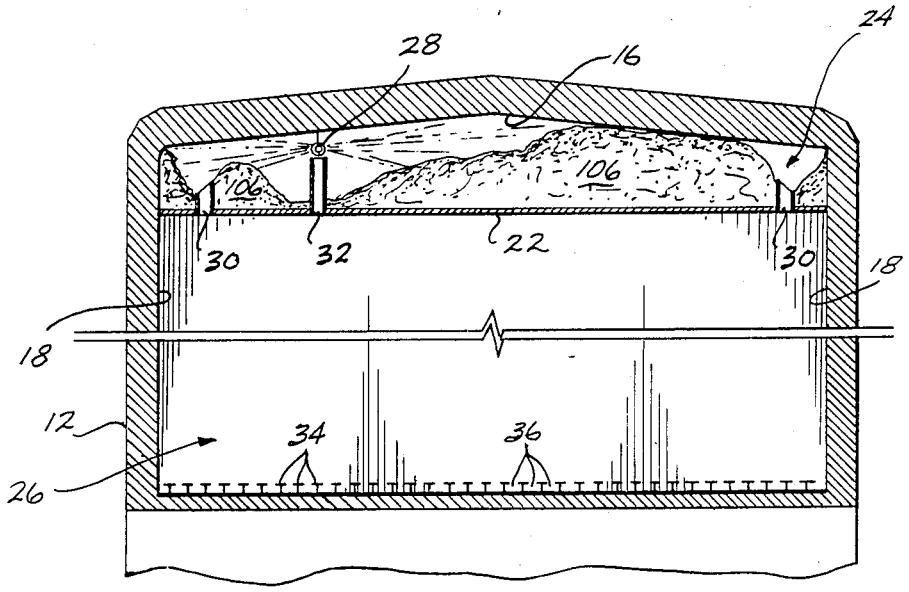
FIG. 4 is an end view in section of the insulated railcar illustrated in FIG. 1 showing an off-center distribution manifold and pressure relief port arrangement.

As more clearly shown in FIGS. 2 and 3, the bunker 24 contains a distribution manifold 28 of circular cross section that runs substantially the entire length of the bunker 24 and is located substantially at the longitudinal center line of the bunker 24. The distribution manifold 28 is suspended from the ceiling 16 by any standard means of attachment. The distribution manifold 28 includes discharge holes 102 located on each side of the manifold. The discharge holes 102 are spaced from one another and are of a diameter that allows the desired formation of carbon dioxide snow 106 and the proper distribution of the formed snow throughout the bunker 24. While a more sophisticated distribution device may be employed, this simple circular manifold containing spaced-apart holes has proven an effective and economical choice. As seen in an alternative form of the present invention shown in FIG. 4, the distribution manifold 28 may be located toward either sidewall 18, and not along the longitudinal center line of the bunker 24. With this arrangement, the number of discharge holes 102, or the diameters of the discharge holes 102, located on the longitudinal center line side of the distribution manifold 28 would have to be greater to provide the required blanket of snow 106.

While the divider 22 may be of one-piece construction, it is preferable that the divider 22 be composed of a series of individual divider sections 104. The divider sections 104 are secured along the sidewalls 18 by standard means of support. While not critical, a tight fit between adjacent divider sections 104 is maintained. This ensures that the snow 106 formed during the snow charging process does not find its way into the storage area 26 below. Unlike prior designs, the divider 22 (or series of divider sections 104) is noninsulated. This is because it is advantageous to have the stored produce, and not the level of insulation, determine the sublimation rate. In essence, it is separation, and not insulation, that is desired.

As shown most clearly in FIGS. 1 and 3, each divider section 104 contains two sublimation ports 30 and one pressure relief port 32.

The sublimation ports 30 are located adjacent the sidewalls 18. Each sublimation port 30 consists of a peripheral housing of rectangular cross section, with a corresponding rectangular hole cut through the divider section 104. The housing extends upwardly from the upper surface of the divider section 104 approximately to the midpoint of the distance between the divider section 104 and the ceiling 16. The surface of the sublimation port 30 located nearest the longitudinal centerline of the divider 22 extends farther in an upward direction than does the opposite surface located nearest the sidewall 18. This sloped shape given to the sublimation port 30 helps resist clogging of the ports during the snow charging process. Preferably, each sublimation port 30 also includes a screen sufficient to prevent the snow 106 from entering the lower storage area 26 (not shown). The divider sections 104 located nearest the end walls 20 contain an extra sublimation port 30 (not shown). This extra port is located adjacent the end wall 20 substantially at the longitudinal centerline of the divider 22, and allows the flow of sublimated carbon dioxide through an aperture adjacent the end walls 20 as well.

Each divider section 104 also includes a pressure relief port 32 located along the longitudinal centerline of the divider 22, thus placing it directly below the distribution manifold 28. In the alternative form of the invention illustrated in FIG. 4, the pressure relief ports 32 again lie directly beneath the distribution manifold 28, but in this arrangement are located away from the longitudinal centerline of the divider 22. Each pressure relief port 32 consists of a peripheral housing of circular cross section, with a corresponding circular hole cut through the divider section 104. The pressure relief ports 32 extend farther in an upward direction than do the sublimation ports 30, each housing extending in an upward direction to within one or two inches of the distribution manifold 28. In this way, there is no way for them to become covered during the snow charging process. As a result, they provide an escape route for the flash gas that is generated as the blanket of snow 106 is being formed. Theoretically, the pressure relief ports may be of any design, so long as they provide an unobstructed area great enough to handle the flash gas created during the snow charging process. Studies have shown, for a standard 60 foot refrigerated railcar, that sixty-four square inches of surface area must be provided to properly vent the flash gas. Under the design illustrated in FIG. 1, each divider section 104 has dimensions of four feet by the width of the insulated railcar 12 (usually eight feet). Thus, there are fifteen relief ports located along the length of the insulated railcar 12. Given this number of ports, a cross sectional diameter of three inches is more than adequate to provide the necessary venting surface area. Preferably, each pressure relief port 32 also includes a snow screen, though, given the location and dimensions of these ports, it is highly unlikely that the snow 106 would ever enter them.

Figure 5:
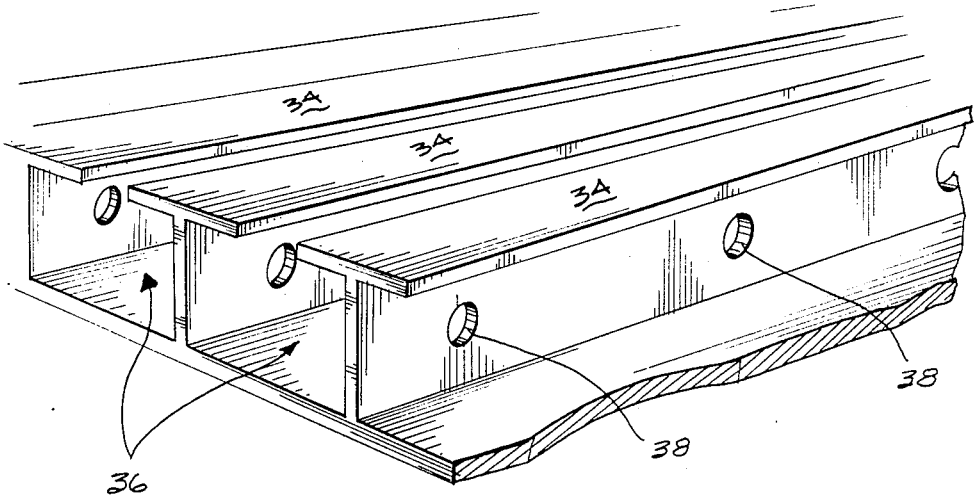
FIG. 5 is an enlarged isometric view of the floor of the refrigerated insulated illustrated in FIG. 1.

The floor 14 of the insulated railcar 12 includes a series of T-beams 34 extending substantially the entire length of the insulated railcar 12 along the surface of the floor 14. The T-beams 34 also extend from one sidewall 18 to the other. As more clearly shown in FIG. 5, the series of T-beams 34 create flow channels 36 for collecting and transporting sublimated carbon dioxide in the lengthwise direction. The T-beams may be attached to the floor 14 by any standard means of attachment (e.g., welding, etc.). Preferably, though, the T-beams 34 and floor 14 are prefabricated as a single unit. The T-beams 34 also contain cross-flow holes 38 periodically spaced along the length of each T-beam 34 that permit the flow of the sublimated carbon dioxide in the widthwise direction.

Referring now to FIGS. 1 and 2, each end of the insulated railcar 12 includes an emission design for venting the collected sublimated carbon dioxide to the exterior atmosphere. This emission design is accomplished by placing an interior wall 40 slightly spaced from the end wall 20. The interior wall 40 covers the entire width of the insulated railcar 12, stretching from one sidewall 18 to the other. The lower surface of the interior wall 40 terminates just before reaching the level of the floor 14. Similarly, the T-beams 34 running the length of the floor 14 terminate just short of the interior wall 40. In this way, a plenum 42 is created to transmit the collected sublimated carbon dioxide to the exterior atmosphere. While an expensive collection manifold could be placed at the ends of the T-beams 34, the inexpensive design of the plenum 42 illustrated works very efficiently. At the upper regions of the plenum 42, an emission vent 44 that extends through the end wall 20 is provided. The emission vent 44 includes a hinged lid 46 that prevents atmospheric air from entering the interior of the insulated railcar. The hinged lid 46 is held in a closed position by magnets which will release at approximately 3 psi of pressure. Therefore, when sufficient pressure builds within the storage area 26, the force of the magnets is overcome and the sublimated carbon dioxide is allowed to vent to the exterior atmosphere.

During the snow charging process, an exterior source of pressurized liquid carbon dioxide is connected to the distribution manifold 28. As the pressurized liquid carbon dioxide exits from the discharge holes 102, it instantaneously turns to a solid, snow-like form due to the reduced pressure of the environment into which it is being transferred. Given the great pressure behind the source of the liquid carbon dioxide, the snow 106 exiting the discharge holes 102 is blown to the outside sidewalls 18 of the bunker 24. The snow 106 continues to build from the outside in until the bunker 24 is essentially full. The sloped design of the sublimation ports 30 is such that they should not become covered with snow. However, in the event that they do, the pressure relief ports 32 provide a more than ample amount of area through which the tremendous build up of flash gas may exit. Thus, the problem of blowing out the divider 22 (or series of divider sections 104) during the snow charging process is eliminated. Furthermore, the pressure relief ports 32 provide the additional advantage of allowing some of the flash gas to exit the bunker 24 into the middle regions of the storage area 26. Thus, more heat is removed from the storage area 26 during the snow charging process than under previously designed refrigerated railcars. Under those designs, the flash gas that left the bunker area remained close to the sidewalls or end walls before exiting the railcar. Yet another advantage of the pressure relief ports 32 is that, unlike prior designs sublimated carbon dioxide is introduced directly into the middle regions of the storage area 26 during transit. Thus, refrigeration efficiency and uniformity is enhanced.

While a preferred embodiment of the invention has been illustrated and described, it should be understood that variations can be made therein without departing from the spirit and scope of the invention. For example, a different floor design may be used so long as proper flow channels are created through which the collected sublimated carbon dioxide can be transported to the emission means at either end of the railcar. By way of example, an egg crate or corrugated design should accomplish this purpose. Furthermore, it is not a requirement that carbon dioxide be employed as the refrigerant. Any cryogenic gas exemplifying similar characteristics could be employed. Additionally, it should be understood that the invention may be incorporated into any container, whether integrated into a vehicle of transportation or capable of standing alone. Accordingly, it is to be understood that the invention is not to be limited to the specific embodiments illustrated and described. Rather, the true scope and spirit of the invention is to be determined by reference to the following claims.

The embodiments of the invention in which an exclusive property or privilege is claimed are defined as follows:

1. A refrigeration system utilizing a cryogenic refrigerant material, the refrigeration system comprising:

an insulated container having a floor, a ceiling, sidewalls, and end walls, said sidewalls defining the length and said end walls defining the width of said insulated container;

dividing means for partitioning said insulated container into an upper bunker and a lower storage area, said dividing means capable of supporting a supply of snow formed of a cryogenic material;

manifold means located in the upper regions of said bunker substantially along the longitudinal centerline of said bunker for forming cryogenic snow and distributing the formed cryogenic snow throughout said bunker;

a plurality of apertures extending through said dividing means adjacent said sidewalls and said end walls for permitting the flow of sublimated cryogenic gas from said bunker to said storage area, said apertures having a first peripheral housing extending substantially above said dividing means into said bunker;

at least one vent extending through said dividing means located substantially along the longitudinal centerline of said dividing means, said at least one vent having a second peripheral housing extending substantially above said dividing means into said bunker;

a plurality of channels extending substantially the entire length of said insulated container along said floor for collecting sublimated cryogenic gas; and emission means communicating between said channels and the exterior of said insulated container for discharging the collected sublimated cryogenic gas to the atmosphere exterior to said insulated container.

2. The refrigeration system of claim 1, wherein said insulated container is an insulated rail car.

3. The refrigeration system of claim 1, wherein said cryogenic material is carbon dioxide.

4. The refrigeration system of claim 1, wherein said dividing means is noninsulated.

5. The refrigeration system of claim 1, wherein said first peripheral housing has a rectangular cross section.

6. The refrigeration system of claim 1, further comprising means for placing adjacent channels in fluid communication to allow flow of sublimated cryogenic gas in the widthwise direction.

7. The refrigeration system of claim 1, further comprising a plurality of vents extending through said dividing means located in a spaced relationship substantially along the longitudinal centerline of said dividing means.

8. A refrigeration system utilizing a cryogenic refrigerant material, the refrigeration system comprising:

an insulated container having a floor, a ceiling, sidewalls, and end walls, said sidewalls defining the length and said end walls defining the width of said insulated container;

dividing means for partitioning said insulated container into an upper bunker and a lower storage area, said dividing means capable of supporting a supply of snow formed of a cryogenic material;

manifold means located in the upper regions of said bunker and running substantially the length of said bunker for forming cryogenic snow and distributing the formed cryogenic snow throughout said bunker;

a plurality of apertures extending through said dividing means adjacent said sidewalls and said end walls for permitting the flow of sublimated cryogenic gas from said bunker to said storage area, said apertures having a first peripheral housing extending substantially above said dividing means into said bunker;

at least one vent extending through said dividing means located substantially below said manifold means, said at least one vent having a second peripheral housing extending substantially above said dividing means into said bunker;

a plurality of channels extending substantially the entire length of said insulated container along said floor for collecting sublimated cryogenic gas; and emission means communicating between said channels and the exterior of said insulated container for discharging the collected sublimated cryogenic gas to the atmosphere exterior to said insulated container.

9. The refrigeration system of claim 8, further comprising a plurality of vents extending through said dividing means located in a spaced relationship substantially below said manifold means.

* * * * *